US006517189B2

(12) United States Patent
Ogawa et al.

(10) Patent No.: US 6,517,189 B2
(45) Date of Patent: Feb. 11, 2003

(54) INK JET PRINT DEVICE AND INK SUPPLY METHOD FOR SUPPLYING INK TO PRINT HEAD OF THE INK JET PRINT DEVICE

(75) Inventors: Toshitaka Ogawa, Hitachinaka (JP); Satoru Tobita, Hitachinaka (JP); Takashi Kagami, Hitachinkaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 26 days.

(21) Appl. No.: 09/780,350

(22) Filed: Feb. 12, 2001

(65) Prior Publication Data

US 2001/0028374 A1 Oct. 11, 2001

(30) Foreign Application Priority Data

Feb. 25, 2000 (JP) ..... 2000-049062

(51) Int. Cl.[7] ..... B41J 2/165

(52) U.S. Cl. ..... 347/35; 347/85; 347/89; 347/84; 347/29; 347/30; 347/86; 347/92

(58) Field of Search ..... 347/35, 29, 30, 347/85, 86, 89, 92, 36, 87, 94, 84

(56) References Cited

U.S. PATENT DOCUMENTS 5,128,690 A * 7/1992 Nozawa ..... 347/30
6,022,102 A * 2/2000 Ikkatai et al. ..... 347/85
6,352,334 B2 * 3/2002 Fukushima et al. ..... 347/33

* cited by examiner

*Primary Examiner*—John Barlow
*Assistant Examiner*—Ly T Tran
(74) *Attorney, Agent, or Firm*—Whitham, Curtis & Christofferson, P.C.

(57) ABSTRACT

A head is formed with a plurality of nozzles and a common ink chamber fluidly connected with the nozzles. A sub ink tank is provided above the head. Ink housed in a main ink tank is supplied into the sub ink tank through the common ink chamber when an image forming operation is not performed. At this time, air bubbles existing in the common ink chamber is brought into the sub ink tank along with the ink supplied from the main ink tank. The air bubbles collected into the sub ink tank in this manner are released into the ambient air through a valve provided to the sub ink tank.

18 Claims, 8 Drawing Sheets

INK JET PRINT DEVICE AND INK SUPPLY METHOD FOR SUPPLYING INK TO PRINT HEAD OF THE INK JET PRINT DEVICE

BACKGROUND OF THE INVENTION

1. Field of the Invention

The present invention relates to an ink jet printing device including a print head formed with a plurality of nozzles for selectively ejecting ink droplets onto a recording medium based on print data so as to form images on the recording medium, and also to an ink supply method for supplying the print head with ink.

2. Related Art

There has been provided a conventional ink jet print device that performs an image forming operation for forming images on a recording medium. Main components of such a conventional ink jet print device are shown in FIG. 8. As shown in FIG. 8, the ink jet print device includes a print head 301 formed with several hundreds of nozzles 302 (only one is shown in FIG. 8), a common ink chamber 307, a supply path 308, and a sub ink tank 309. A motor (not shown) is provided for reciprocally moving the print head 301 in a direction that is perpendicular to the sheet surface of FIG. 8. A recording medium 313 is placed in confrontation with the nozzles 302.

Each nozzle 302 includes an orifice 303, an ink chamber 305, and a restrictor 306, all are in fluid communication with one another. The restrictor 306 regulates the amount of ink that is supplied from the common ink chamber 307 into the ink chamber 305. A recording medium 313 is placed in confrontation with the orifices 314. A piezoelectric element 304 is mounted on a partition wall of the ink chamber 305. The piezoelectric element 304 is an energy generating member that is deformed and undeforms based on driving signals.

The sub ink tank 309 is connected to a pressure pump 311 via a deformable duct 312, and further to a main ink tank 310.

With this configuration, the image forming operation is performed by selectively ejecting an ink droplet 314 through the orifices onto the recording medium 313 while reciprocally moving the print head 301. The ink droplet 314 is ejected through the orifice 303 in the following manner.

That is, first, the piezoelectric element 304 is deformed based on a driving signal, so that the volume of the ink channel 305 increases. As a result, internal pressure of the ink channel 305 decreases, and ink in the common ink chamber 307 is introduced into the ink chamber 305 through the ristrisctor 306. Next, the deformation of the piezoelectric element 304 is released. The volume of the ink chamber 305 drops to its initial amount, so the internal pressure of the ink chamber 305 increases. As a result, an ink droplet 314 is ejected through the orifice 303. Each time an ink droplet 314 is ejected, ink in the sub ink tank 306 is introduced into the common ink chamber 307 through the supply path 308 to supplement the consumed ink.

In the above-described print head, ink level in the ink tank 309 is set lower than the position of the orifice 303 by a level difference Ho in a vertical direction. In this way, ink in the ink chamber 305 is prevented from leaking through the orifice 303. Also, a sensor 315 is provided to the sub ink tank 309 for detecting the remaining amount of ink in the sub ink tank 309. As the ink is consumed, the ink level is lowered and the level difference Ho increases. When the sensor 315 detects that the level difference Ho becomes greater than a predetermined height, then the pressure pump 311 supplies ink from the main ink tank 310 into the sub ink tank 309. That is, the pressure pump 311 sucks up the ink from the main ink tank 310, and then applies pressure to the sucked-ink. As a result, a predetermined amount of ink is supplied into the sub ink tank 309 via the duct 312.

Also, the ink in the sub ink tank 309 is exposed to the ambient air through openings 399. Because the sub ink tank 309 is not sealed off from the outside, pressure applied to the nozzle 302 will not greatly fluctuate even when the print head 301 is reciprocally moved. Also, because the main ink tank 310, which has relatively a large volume, is not mounted on the print head 301, the motor for driving the print head 301 can be smaller.

However, in the above-described ink jet print device, when the piezoelectric elements increase and decrease the internal pressure of the ink chamber 305 for ejecting the ink droplet 314, air bubbles are generated in the ink in the nozzles 302. Such air bubbles prevent proper ink ejection, so degrade image quality.

Because the print head 301 is formed with a large number of nozzles 302, image forming can be performed at high speed. However, when the print head 301 is formed with a larger number of nozzles 302, air bubbles are more likely to be generated.

Also, when the print head 301 is reciprocally moved, the velocity of the print head 301 is repeatedly accelerated and decelerated. This acceleration and deceleration changes pressure applied to the ink in the print head 301, especially when the moving direction of the print head 301 is reversed. As a result, air bubbles are easily generated.

Moreover, air bubbles are also generated in the main ink tank 310 and the duct 312. When these air bubbles are supplied to the print head 301 along with ink, the air bubbles also prevent proper ink ejection.

In order to overcome the above-described problems, the ink jet print device executes a purging operation for forcefully removing such air bubbles. During the purging operation, first, the print head 301 is moved to a predetermined purging position that is outside of a recording region. A purging mechanism 320 is provided in the purging position, and includes a cap 321, a suction pump 322, and a purge tank 325. The cap 321 includes a seal member 323. Then, the cap 321 is lifted up and seals the print head 301. In this condition, the suction pump 322 sucks up and removes air bubbles along with ink from the nozzles 302.

However, it is difficult to remove air bubbles from the common ink chamber 307, a connecting portion between the ristrictor 306 and the common ink chamber 307, a connection portion between the common ink chamber 307 and the supply path 308, and the supply path 308 even in the above-described purging operation. In order to remove these air bubbles, it is conceivable to use a suction pump with greater power. It is also conceivable to drive the suction pump 322 for a increased time duration. However such operations increase the size of the ink jet print device and also decrease the printing speed. Also, the amount of ink consumed during the purging operation increases, which is uneconomical.

SUMMARY OF THE INVENTION

It is an objective of the present invention to overcome the above problems, and to provide an ink supply method for reliably removing air bubbles remaining in print head without wasting ink, and also to provide an ink jet print device that performs the ink supply method.

In order to achieve the above and other objectives, there is provided an ink jet print device including a head, a sub ink tank, a main ink tank, a first switching valve, and a second switching valve. The head is formed with a plurality of nozzles and a common ink chamber in fluid communication with each of the nozzles. Each nozzle is formed with an orifice through which an ink droplet is ejected. The common ink chamber has a first end and a second end. The sub ink tank stores ink and supplies the ink to the nozzles. The main ink tank stores ink and supplies the ink to the sub ink tank. The first switching valve is provided to the first end of the common ink chamber, and is selectively switched to an opening condition where the common ink chamber is in fluid connection with the sub ink tank and a closed condition where the common ink chamber is in fluid disconnection from the sub ink tank. The second switching valve is provided to the second end of the common ink chamber. The second switching valve is selectively switched to a first condition where the common ink chamber is in fluid connection with the sub ink tank and fluid disconnection from the main ink tank and a second condition where the common ink chamber is in fluid connection with the main ink tank and fluid disconnection from the sub ink tank. The sub ink tank supplies the ink to the nozzles through the common ink chamber, and the main ink tank supplies the ink to the sub ink tank through the common ink chamber.

There is also provided an ink supply method including the steps of a) switching a first valve to fluidly connect to a first side of a common ink chamber to a sub ink tank, b) switching a second valve to fluidly connect a main ink tank to a second side of the common ink chamber and to fluidly disconnect the sub ink tank from the second side of the common ink chamber, and c) driving a pump provided between the main ink tank and the second side of the common ink chamber so as to provide ink from the main ink tank through the common ink chamber into the sub ink tank.

BRIEF DESCRIPTION OF THE DRAWINGS

In the drawings:

FIG. 4(*b*) is a flowchart representing a remaining half of the processes of FIG. 4(*a*);

PREFERRED EMBODIMENTS OF THE PRESENT INVENTION

Next, ink jet print devices according to embodiments of the present invention will be described while referring to the accompanying drawings. According to the present invention, ink is supplied into a sub ink tank through a common ink chamber so that air bubbles existing in the common ink chamber are collected into the sub ink tank. Details will be described below.

Figure 1:
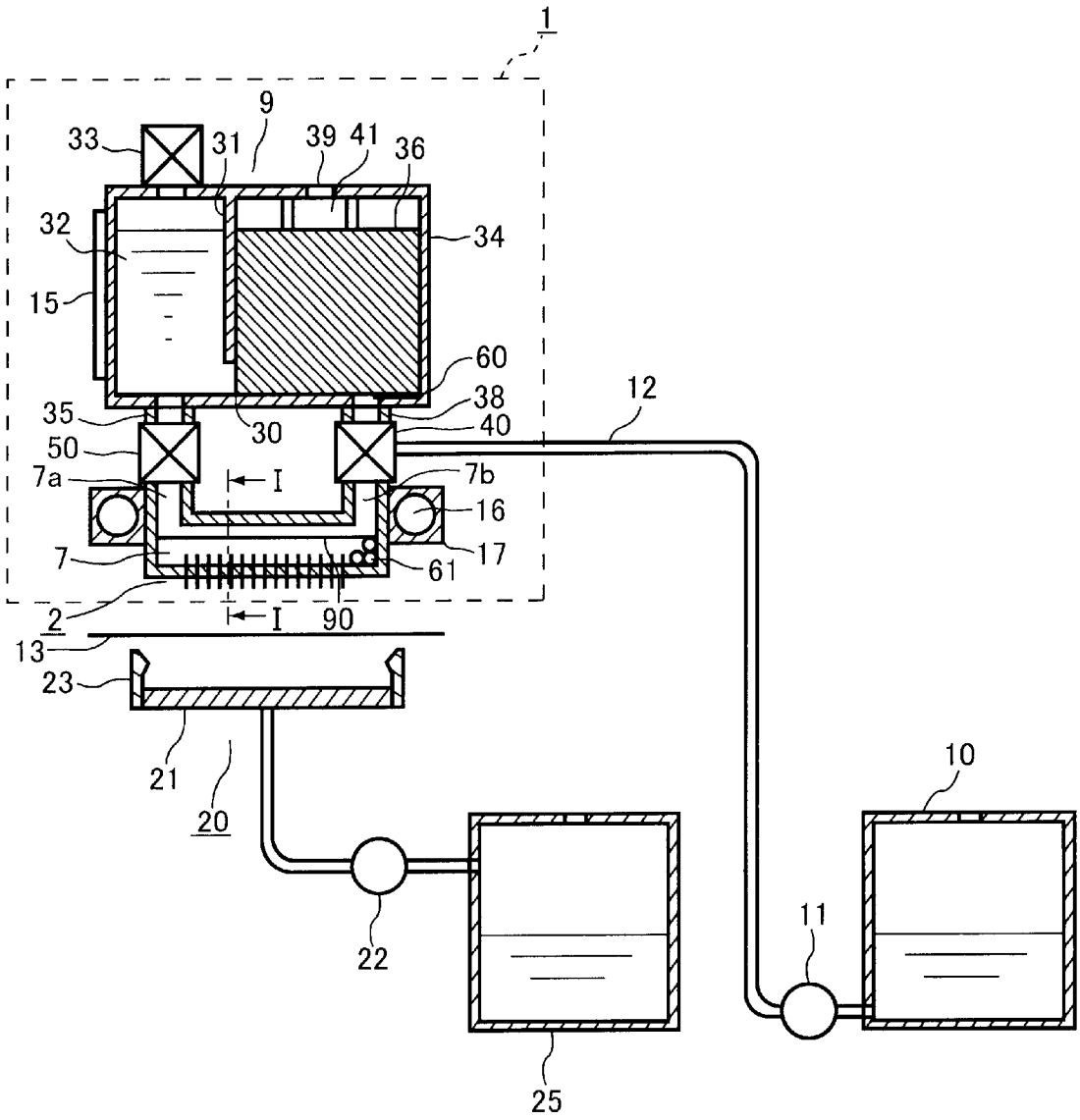
FIG. 1 is a cross-sectional view showing main components of an ink jet print device according to a first embodiment of the present invention.
Figure 3:
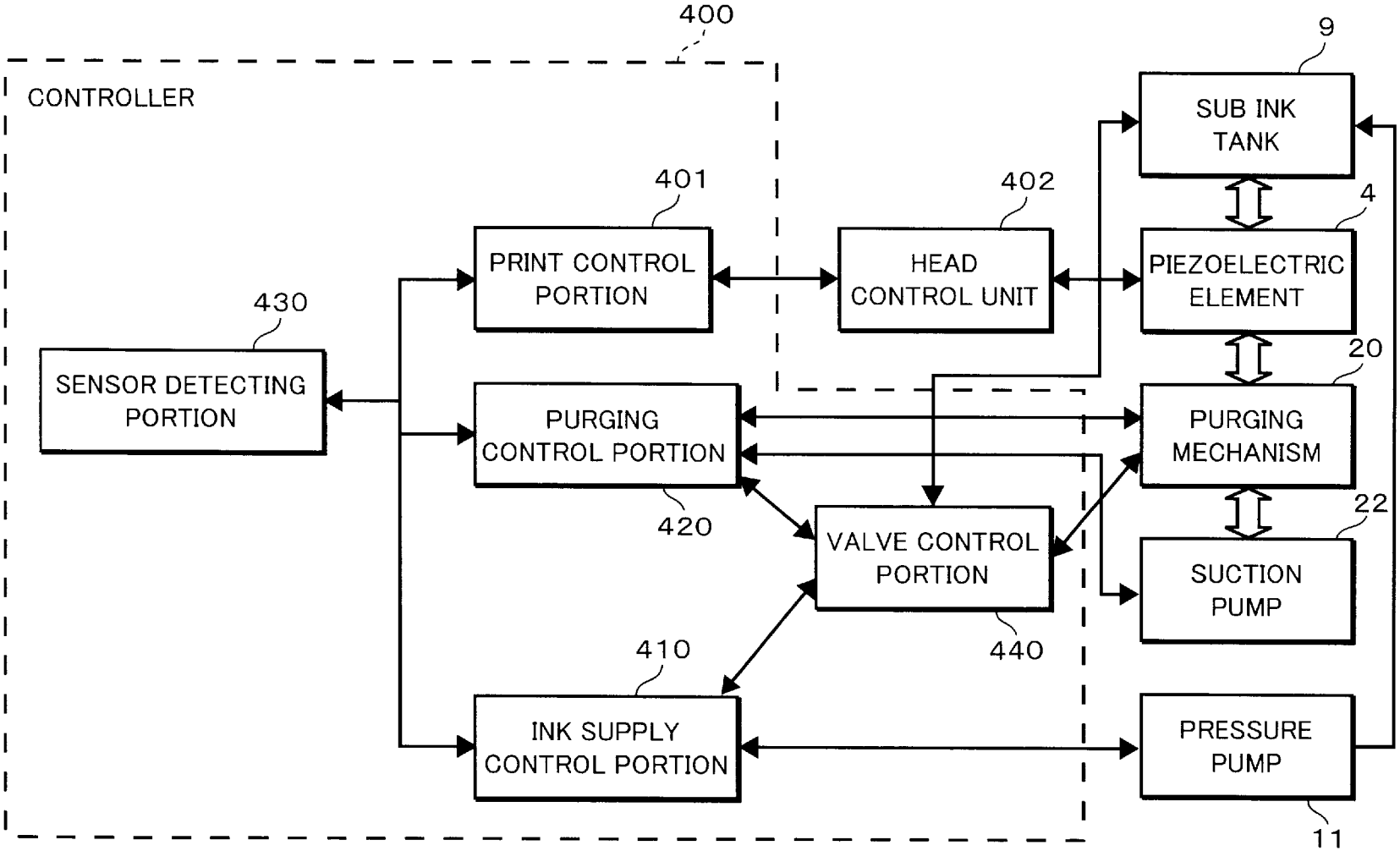
FIG. 3 is a block diagram showing components of the ink jet print device of FIG. 1.

First, an ink jet print device according to a first embodiment of the present invention will be described. As shown in FIG. 1, an ink jet print device of the present embodiment includes a print head 1, a guide 16, a carriage 17, a main ink tank 10, a purging mechanism 20, and a controller 400 (FIG. 3).

The print head 1 is placed in confrontation with a recording medium 13. The carriage 17 is slidably mounted on the guide 16. The print head 1 is mounted on the carriage 17. A driving unit (not shown) drives the carriage 17 to reciprocally move along with the print head 1 in a direction perpendicular to a sheet surf ace of FIG. 1. The main ink tank 10 is placed on a main body (not shown) of the ink jet print device and is connected to the print head 1 by a deformable duct 12 via a pressure pump 11. The purging mechanism 20 is provided in a purging position outside of a printing region.

The print head 1 is formed with. a plurality of nozzles 2, a common ink chamber 7, and a sub ink tank 9. The common ink chamber 7 is fluidly connected to the plurality of nozzles 2 for supplying ink thereto.

Figure 2:
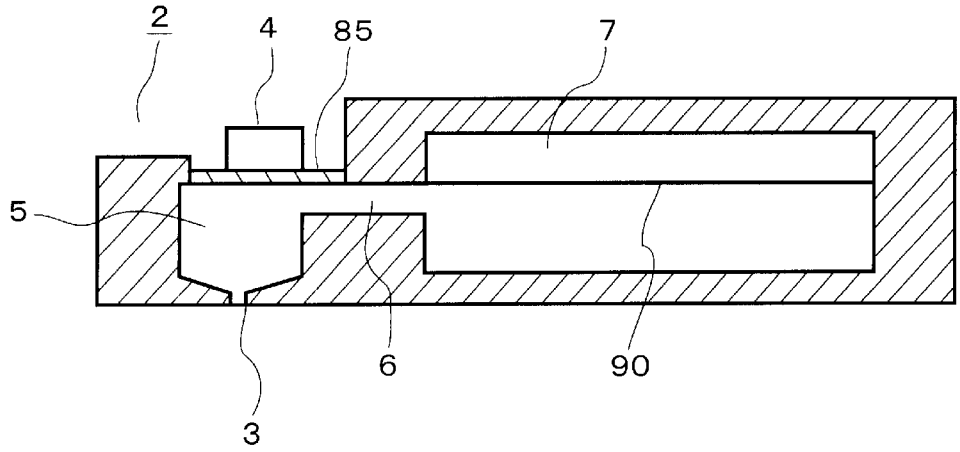
FIG. 2 is a cross-sectional view showing a nozzle of a print head of the ink jet print device taken along a line I—I of FIG. 1.

As shown in FIG. 2, each nozzle 2 includes an orifice 3, an ink chamber 5, a restrictor 6, and a piezoelectric element 4. An ink droplet is ejected through the orifice 3. The ink chamber 5 is filled with ink and fluidly connected to the orifice 3. The restrictor 6 regulates an ink amount supplied from the common ink chamber 7 into the ink chamber 5. The piezoelectric element 4 is mounted on a surface of a partition wall that defines the ink chamber 5. The piezoelectric element 4 is an energy generating member that expands and contracts in response to driving signals. Although in the present invention the piezoelectric element 4 is used, any other energy generating member can be used.

A filter 90 is mounted in the common ink chamber 7 so as to cover all of the plurality of nozzles 2. The filter 90 is formed with filtering paths which have a sufficiently small size with respect to the diameter of the orifice 3.

As shown in FIG. 1, the sub ink tank 9 is provided above the nozzles 2 and the common ink chamber 7, and is divided by a partition wall 31 into an ink pool chamber 32 and an ink absorbing chamber 34. The partition wall 31 is formed with a supply port 30, so that the ink pool chamber 32 and the ink absorbing chamber 34 are in fluid communication with each other.

The ink pool chamber 32 is formed with an ink inport 35 at its bottom surface. A switching valve 50 is provided at the ink inport 35. When the switching valve 50 is in its open condition, the ink pool chamber 32 and one end of the common ink chamber 7 are fluidly connected with each other via the ink inport 35. On the other hand, when the switching valve 50 is in its closed condition, the switching valve 50 disconnects the pool chamber 32 from the common ink chamber 7. A switching valve 33 is provided to an upper surface of the ink pool chamber 32. When the switching valve 33 is in its open condition, ink housed in the ink pool chamber 32 is exposed to the ambient air. That is, the ink has a free ink level. An ink amount detecting sensor 15 is provided in the ink pool chamber 32. The sensor 15 detects an low ink level when the ink remaining amount in the ink pool chamber 32 decreases below a predetermined ink amount.

An ink absorbing member 36 is housed in the ink absorbing chamber 34. The ink absorbing member 36 is formed from an absorbing material, such as a sponge material. The ink absorbing member 36 absorbs and holds ink which is supplied from the ink pool chamber 32 via the supply port 30. The ink absorbing chamber 34 is formed with an opening 39 and an air chamber 41 at is upper surface, and also with an ink outport 38 at its lower surface. The air chamber 41 is exposed to the ambient air. An absorbing piece 60 is provided to the ink outport 38.

A switching valve 40 is provided near the ink outport 38. The switching valve 40 is selectively switched between. its first condition and its second condition. When the switching valve 40 is in its first condition, the ink absorbing chamber 34 is fluidly connected with the second end 7*b* of the common ink chamber 7 via the ink outport 38 while the main ink tank 10 is fluidly disconnected from the common ink chamber 7. On the other hand, when the switching valve 40 is in its second condition, the ink absorbing chamber 34 is fluidly disconnected from the second end 7*b* of the common ink chamber 7 while the main ink tank 10 is fluidly connected to the common ink chamber 7 via the duct 12.

The purging mechanism 20 includes a cap 21, a suction pump 22, and a purge tank 25. The cap 21 includes a sealing member 23. The cap 21 and the purge tank 25 are connected with each other via the suction pump 22.

As shown in FIG. 3, the controller 400 includes a print control portion 401, a purging control portion 420, an ink supply control portion 410, a valve control portion 440, and a sensor detecting portion 430, and controls each component in a manner described later. For example, the print control portion 401 controls a head control circuit 402 to selectively drive the piezoelectric elements 4 during printing operations. When an low ink level is detected during a printing operation, then the ink supply control portion 410 and the purging control portion 420 controls the valve control portion 440, the pressure pump 11, the suction pump 22, and the like, and executes an ink supply operation and a purging operation.

Next, operations and conditions of each component during a printing operation will be described while referring to FIG. 1.

During the printing operation, the switching valve 40 is set to the first condition so that the ink absorbing chamber 34 is fluidly connected to the second end 7*b* of the common ink chamber 7. The switching valve 50 is set to the closed condition so that the ink pool chamber 31 is fluidly disconnected from the first end 7*a* of the common ink chamber 7. The switching valve 33 is set to the closed condition so that the ink in the ink pool chamber 32 is sealed off the ambient air. Accordingly, the ink in the ink pool chamber 32 is in fluid communication only with the ink absorbing chamber 34.

In this condition, the piezoelectric element 4 is deformed in response to a driving signal, so that the volume of the ink chamber 5 increases. As a result, ink is introduced into the ink chamber 5 from the common ink chamber 7 via the restrictor 6. Subsequently, the deformation of the piezoelectric element 4 is released, so the volume of the ink chamber 5 is reduced to its initial amount. This increases internal pressure of the ink chamber 5, so that an ink droplet 14 is ejected through the orifice 3 onto the recording medium 13. As a result, internal pressure of the common ink chamber 7 decreases, so that ink is introduced from the ink absorbing chamber 34 via the absorbing piece 60. At this time, air bubbles, debris, and other materials contained in the ink are caught by the filter 90 so are prevented from entering into the ink chamber 5.

It should be noted that the ink absorbing member 36 is formed from urethane rubber for example. The ink absorbing member 36 is formed with continuous pore capable of holding liquid, and has an ink holding pressure level of about several tens of millimeters with respect to the pressure level of the ink in the common ink chamber 7. With this configuration, ink in the ink absorbing chamber 34 will not flow to the nozzle 2 unless the decrease in pressure in the common ink chamber 7 exceeds the ink holding level of the absorbing member 36 during the printing operation. In other words, ink will be supplemented from the sub ink tank 9 only to those nozzles 2 that have ejected an ink droplet, and will not be supplemented to those that have not. Because the ink will not be supplied to nozzles 2 that have not ejected an ink droplet, internal pressure in these nozzles 2 will not be unnecessarily increased, so that ink is prevented from undesirably leaking from the nozzles 2. Accordingly, the recording medium 13 is prevented from being smeared by leaked ink.

Also, during acceleration and deceleration of the reciprocal movement of the print head 1, the ink absorbing member 36 securely holds the ink. Therefore, fluctuation in pressure applied to ink in the nozzle 2 will be suppressed, so problems due to such pressure fluctuation can be prevented.

When ink in the ink absorbing chamber 34 is supplied into the common ink chamber 7 in the above-described manner, then ink housed in the ink pool chamber 32 is introduced into the ink absorbing chamber through the supply port 30. In this way, the printing operation proceeds.

Figure 4A:
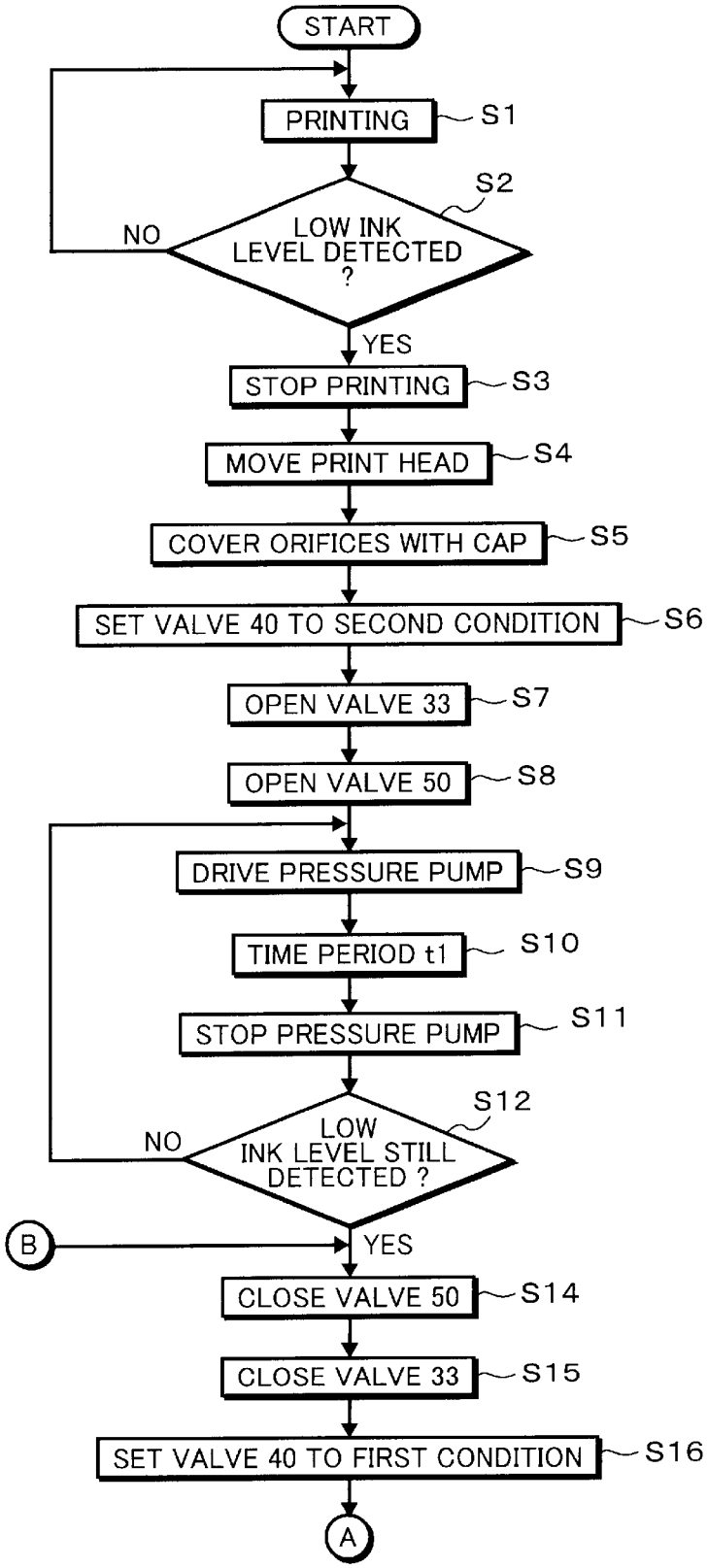
FIG. 4(*a*) is a flowchart representing a first half of processes executed by the ink jet print device.
Figure 4B:
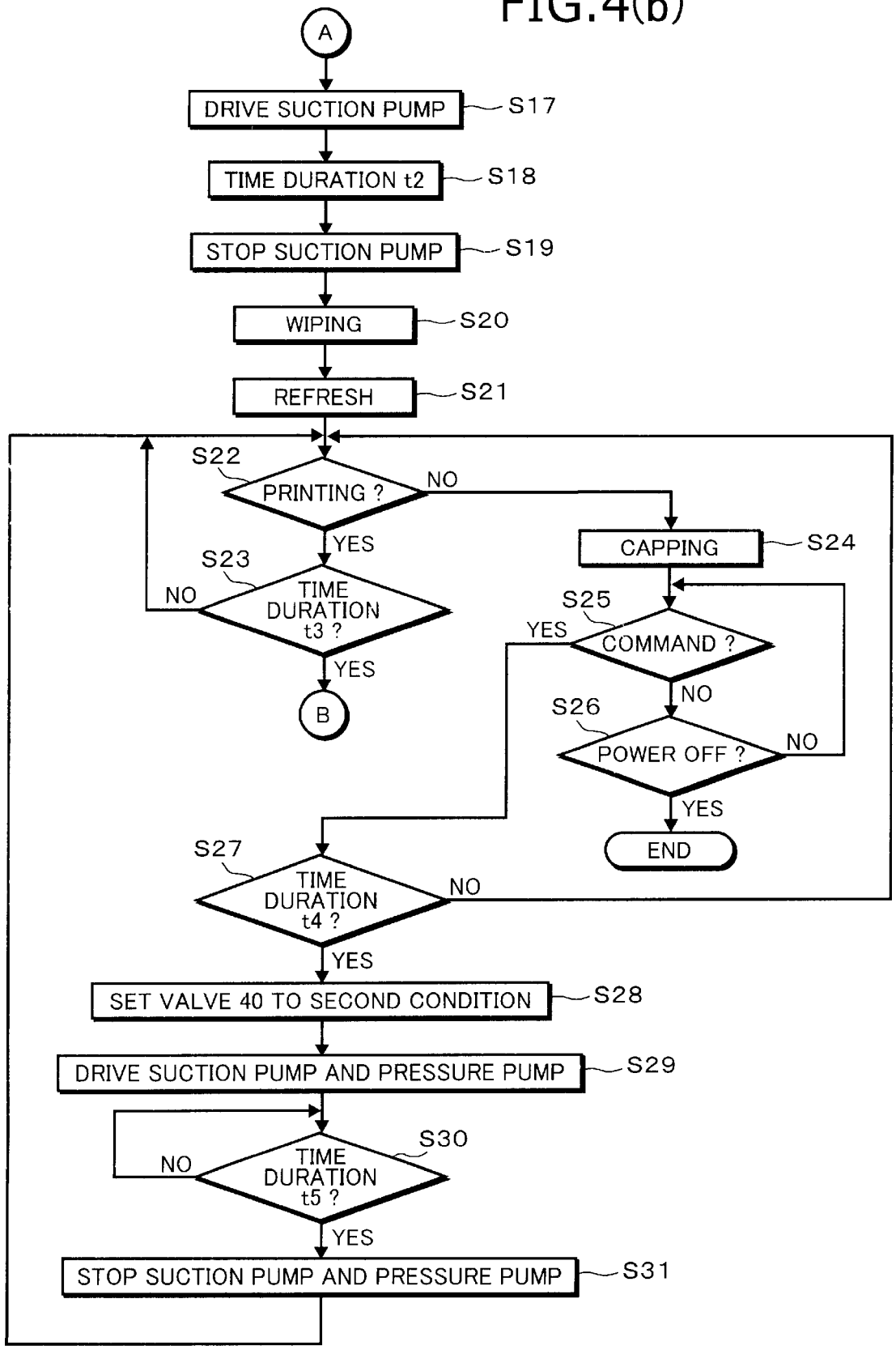

Next, processes executed when low ink level is detected by the sensor 15 will be described while referring to the flowchart shown in FIGS. 4(*a*) and 4(*b*).

When the printing operation proceeds in S1 in the above-described manner, ink level in the ink pool chamber gradually decreases. When the sensor 15 detects a low ink level indicating that the ink amount is below the predetermined amount (S2:YES), then the printing operation is stopped in S3. It should be noted that in the present embodiment, at the time when the sensor 15 first detects the low ink level, a certain amount of ink is still remaining in the sub ink tank 9. Therefore, there is no need to immediately halt the printing operation. Instead, the printing operation can be stopped at an appropriate timing when, for example, no more printing signal is received.

After S3, an ink supply operation and a purging operation are performed in this order. The purging operation will be described next.

That is, after S3, the print head 1 is moved in S4 to a predetermined purging position where the purging mechanism 20 is located. Then in S5, the purging mechanism 20 approaches the print head 1, so that all orifices 3 of the print head 1 are covered with the cap 21 in a sealed condition. Next in S6, the switching valve 40 is set to the second condition so that the main ink tank is fluidly connected to the common ink chamber 7 via the duct 12, and that the ink absorbing chamber 34 is fluidly disconnected from the second end 7*b* of the common ink chamber 7. In S7, the switching valve 33 is opened so that ink in the ink pool chamber 32 is opened to the ambient air. In S8, the switching valve 50 is set to the open condition so that the ink pool chamber 32 is in a fluid communication with the first end 7*a* of the common ink chamber 7. As a result, an ink path is formed along the main ink tank 10, the pressure pump 11, the duct 12, the switching valve 40, the common ink chamber 7, the switching valve 50, and the ink pool chamber 32.

In this condition, in S9, the pressure pump 11 is driven to supply a predetermined amount of ink from the main ink tank 10 to the print head 1 via the duct 12. The supplied ink flows through the switching valve 40, the common ink chamber 7, the switching valve 50, and is introduced into the ink pool chamber 32. Usually, air bubbles with a relatively large size exist in the ink path extending from the main ink tank 10 to the ink pool chamber 32. However, the ink flow along the ink path forcefully removes such air bubbles and brings them into the ink pool chamber 32. Also, the ink flows through the common ink chamber 7 along the surface of the filter 9 provided in the common ink chamber 7. This ink flow removes air bubbles remaining on the surface of the filter 9. The air bubbles collected into the ink pool chamber 32 then rise upward in the ink and are released to the ambient air via the switching valve 33.

When the pressure pump 11 has been driven for a predetermined time period t1 (S10), then in S11, the pressure pump 11 is stopped, and the process proceeds to S12. Because of the above-described ink supply operation, the ink remaining amount in the ink pool chamber 32 is increased. If the ink supply amount is sufficient, then the low ink level is no longer detected (S12:NO), and the process proceeds to S13. On the other hand, if the remaining ink amount is not sufficient, then the low ink level is still being detected (S12:YES), so the process returns to S9.

As described above, according to the present invention, air bubble can be effectively and reliably removed from the ink path during the ink supply operation. Therefore, air bubbles can be removed without wasting any ink. Also, because air bubbles are released into the ambient air via the sub ink tank 9 by simply introducing ink from the main ink tank 10, there is no need to provide an additional duct to collect air bubbles from the print head 1.

Subsequently, the purging operation is started. It should be noted that during the purging operation, the print head 1 is maintained at the purging position, and that the cap 21 is maintained covering over the orifices 3 of the print head 1.

Once the purging operation is started, first in S14, the switching valve 50 is set to the closed condition. In S15, the switching valve 33 is closed. The switching valve 40 is set to the first condition so that the ink absorbing chamber 34 is in fluid communication with the second end 7*b* of the common ink chamber 7 and that the main ink tank 10 is fluidly disconnected from the common ink chamber 7. As a result, an ink path is defined from the ink chamber 34, the switching valve 40, the common ink chamber 7, and the nozzle 2.

Then, in S17, the suction pump 22 is driven to generate negative pressure so as to suck up and collect ink from the print head 1 through the orifices 3. At this time, air bubbles existing in the nozzle, that is, the restrictor 6, the ink chamber 5, the orifice 3, are also removed along with the ink. The collected ink and the air bubbles are then discharged into the purging tank 25.

Because the. air bubbles including those on the filter 9 have already been removed during the ink supply operation, only the air bubbles remaining in the nozzle 2, such as air bubbles 61 shown in FIG. 1, should be removed during the purging operation. Therefore, the air bubbles can be effectively and almost completely removed. Also, because only a small amount of air bubbles should be removed during the purging operation, only a small amount of ink is consumed at this time. This is economical.

When the suction pump 22 has been driven for a predetermined time duration t2 (S18), then the suction pump 22 is stopped in S19. Next in S20, a well known wiping operation is performed, wherein ink remaining-on the print head 1 is removed by a rubber plate and the like (not shown). In S21, a well-known refresh operation is performed, wherein a small amount of ink is ejected from the nozzles 3. As a result, a proper condition of the print head 1 is recovered, and the purging operation is completed.

Next, the process proceeds to S22 for continuing the printing operation. If the printing operation has been performed for a predetermined time duration t3 (S23:YES), then the process returns to S14, so that the purging operation, corresponding to the processes from S14 to S21, is performed. Then, the printing operation is proceeded in S22. If the printing operation is completed (S22:NO), then the nozzles 2 are covered with the cap 23 in S24, so that ink in the nozzles 2 is prevented from drying out.

If a command for a next printing operation is not received (S25:NO), and a main power of the ink jet print device is turned OFF in S26, then the present process is ended.

If a command for starting a next printing operation is received (S25:YES), then in S27 it is determined if a predetermined time duration t4 has elapsed since S24. If not (S27:NO), then the process returns to S22 to perform the printing operation. On the other hand, if so (S27:YES), this mean that because the ink jet print device has not been used for a certain duration of time, air bubbles are more likely existing within the nozzles 2, and also viscosity of ink around the orifices 3 has possibly increased. Therefore, a second purging operation is performed in the following manner before a printing operation is started. That is, in S28, the switching valve 40 is set to the second condition so that the main ink tank 10 is in a fluid communication with the common ink chamber 7 via the duct 12, and that the ink absorbing chamber 34 is fluidly disconnected from the second end 7*b* of the common ink chamber 7. It should be noted that at this time the cap 23 is maintained covering over the nozzles 2, and that the switching valve 50 is kept in the closed condition. Next in S29, the pressure pump 11 and the suction p ump 22 are driven. As a result, ink is supplied from the main ink tank 10 to the nozzle 2 through the common ink chamber 7. At the same time, the ink in the nozzle 2 is collected by the purging mechanism 20 into the purging tank 25. In this way, air bubbles and high viscosity ink are reliably removed from the print head 1.

Usually, a relatively high pressure should be generated to remove air bubbles and high viscosity ink from the print head 1. However, during the second purging operation of the present invention, a pressure as great as several atmospheres can be easily generated by using both the pressure pump 11 and the suction pump 22. Such a high pressure can push a large amount of ink and effectively and reliably remove air bubbles and high viscosity ink. Further, because the main ink tank 10 is formed greater in size than the sub ink tank 9, a large ink flow can be easily generated during the second purging operation.

After the pressure pump 11 and the suction pump 22 have been driven for a predetermine time duration t5 (S30:YES), then in S31, the pressure pump 11 and the suction pump 22 are stopped. Then the process returns to S22 for performing the printing operation.

It should be noted that in the above-described embodiment the switching valve 50 is maintained in its open condition during the purging operation. However, the present invention is not limited to this configuration. For example, the switching valve 50 can be an electromagnetic switching valve, and the electromagnetic switching valve can be set to its closed condition during the purging operation. In this case, when internal pressure of the common ink chamber 7 increase because the pressure pump 11 supplies ink to the common ink chamber 7, then the electromagnetic switching valve is forced open for a moment. At this time, the ink flows into the sub ink tank 9, so that the internal pressure of the common ink chamber 7 decreases. In this manner, the electromagnetic switching valve is repeatedly and intermittently opened and closed, and the ink flowing through the ink path alternatively receives increased and decreased pressure. This alternating pressure applies impact to air bubbles in the ink path, thereby more effectively removing the air bubbles.

Also, as the pressure increases in the ink, the volume of the air bubbles gradually decreases. When the electromagnetic switching valve is opened for a moment, the pressure to the air bubbles drops, so that the shrunken air bubbles vibrate and expand to their initial volume. This vibrating movement changes the clinging force between the air bubbles and inner surfaces of the ink path. Therefore, even air bubbles that are attached to the inner surface can be easily removed.

Figure 5:
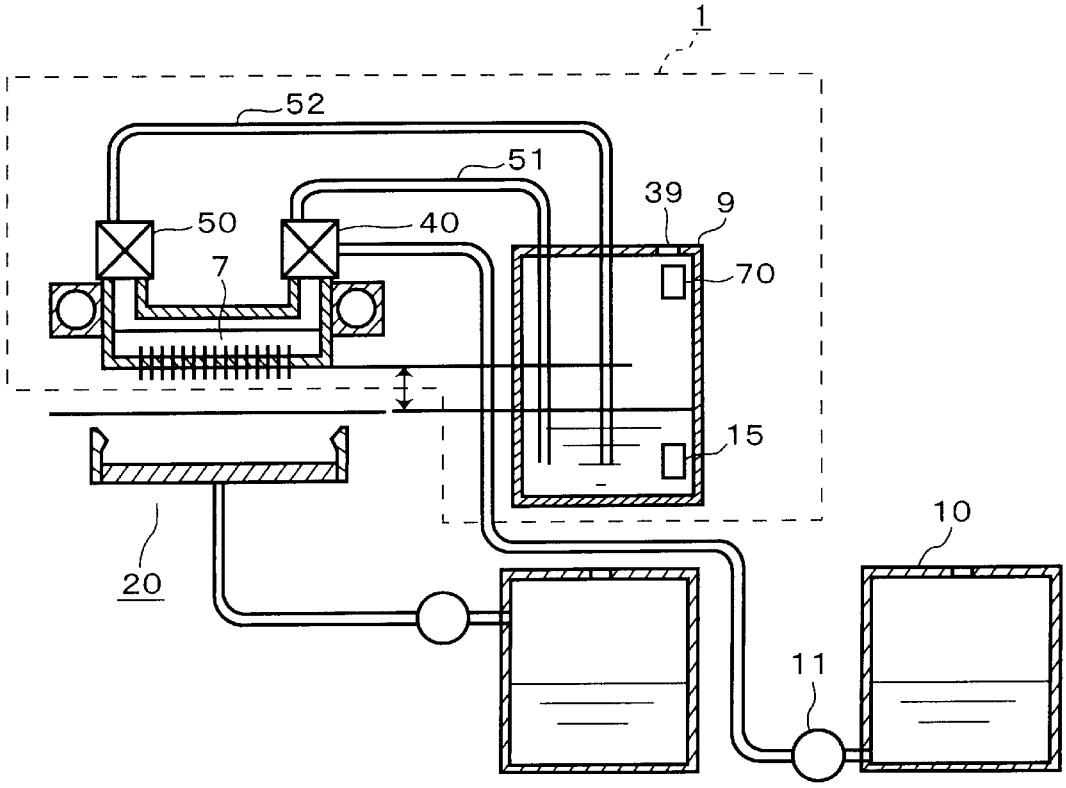
FIG. 5 is a cross-sectional view showing main components of an ink jet print head according to a modification of the first embodiment.

Although only one sensor 15 is provided to the ink jet print device of the above-described embodiment, an additional sensor 70 can be provided as shown in FIG. 5. The sensor 70 is provided in the sub ink tank 9 for detecting a high ink level. With this configuration, the ink supply operation can be performed based on detection results from the both sensors 15 and 70 so that air bubbles in the common ink chamber 7 can be further effectively removed.

For example, when neither the low ink level nor the high ink level is detected by the sensors 15, 70, this means that the ink level is somewhere between the low ink level and the high ink level. Now it is assumed that air bubbles are likely generated in the print head 1 because, for example, the ink jet print device has not been used for a certain duration of time. In this case, the ink supply operation is performed to supply ink into the sub ink tank 9 until the sensor 70 detects the high ink level. Because the ink supply operation can be performed for the maximum duration of time, air bubbles can be further reliably removed from the ink path. Subsequently, the purging operation can be performed.

Also, the ink supply operation can be performed not only before starting the printing operation, but also in the middle of the printing operation as needed, such as when a predetermined time duration elapses after the ink supply operation was last performed. In this case also, the ink supply operation can be performed for a maximum possible duration of time until the sensor 70 detects the high ink level.

As described above, by providing the additional sensor 70, air bubbles can be further reliably removed.

Figure 6:
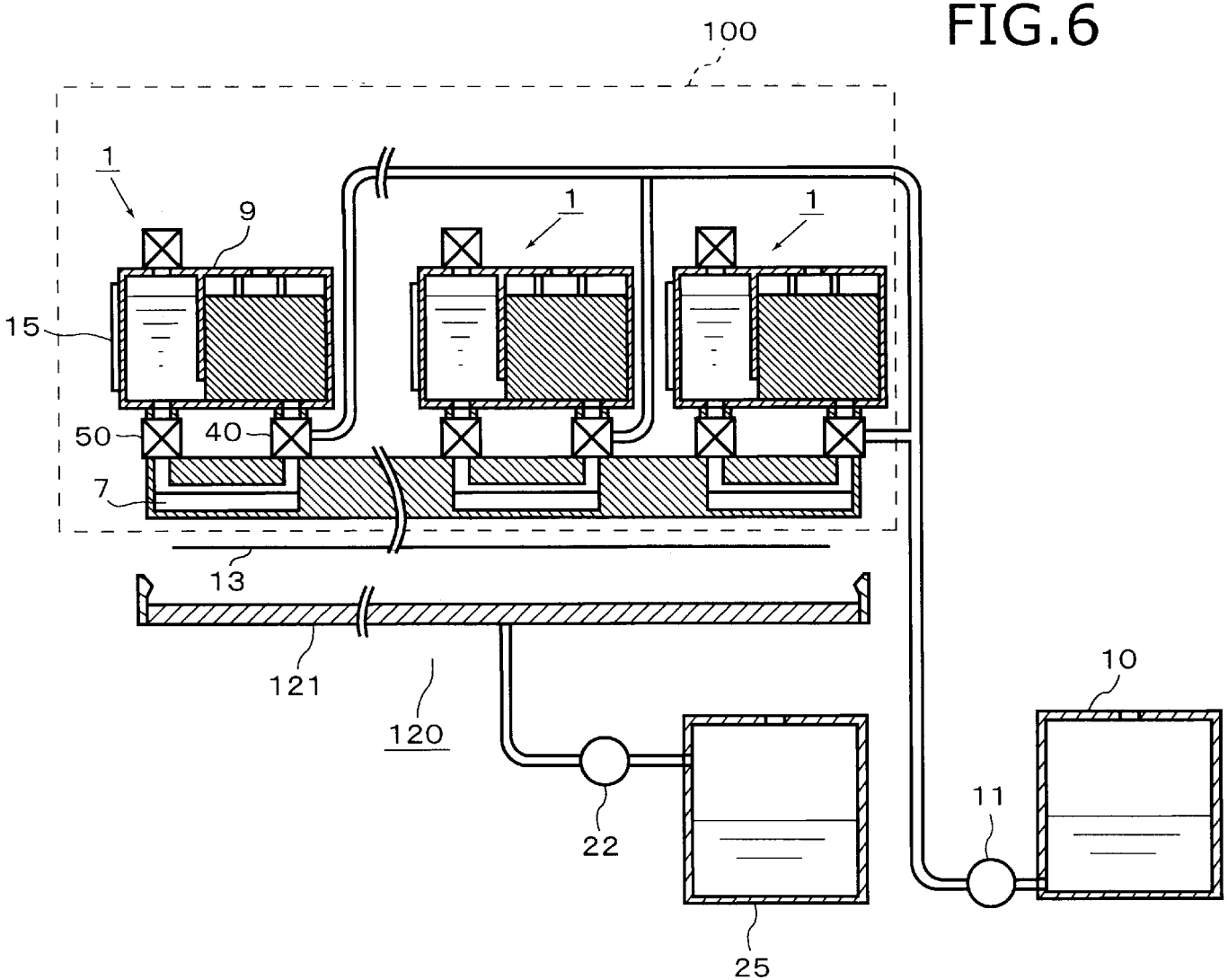
FIG. 6 is a cross-sectional view showing main components of an ink jet print device according to a second embodiment of the present invention.

Next, an ink jet print device according to a second embodiment of the present invention will be described while referring to FIG. 6. As shown in FIG. 6, the ink jet print device of the second embodiment includes a head unit 100 and a purging mechanism 120. The head unit 100 includes a plurality of print heads 1 and has an elongated length corresponding to a width of the recording medium 13. The common ink chambers 7 of the print heads 1 are connected to the main ink tank 10 via a pressure pump 11 and the respective switching valve 40. The purging mechanism 120 includes a cap 121 which has a width sufficient for covering the entire width of the head unit 100. It should be noted that the common ink chamber 7 has a sufficiently short length in the widthwise direction of the recording medium 13 for supplying a sufficient amount of ink to each nozzle 2.

With this configuration, the ink supply operation can be performed for selective one or ones of the print heads 1. That is, the switching valve 40 and the switching valve 50 of each print head 1 are individually controlled based on a detection signal from the corresponding sensor 15. For the print heads 1 whose sensor 15 detects the low ink level, the switching valve 40 is set to the second condition and the switching valve 50 is set to the open condition. The switching valve 40 and 50 are set to the first condition and the closed condition, respectively, for the remaining print heads 1. Then, while the cap 121 of the purging mechanism 120 covers the head unit 100, the pressure pump 11 is driven. As a result, ink is supplied only to the common ink chamber 7 of the selected print heads 1. In this way, the ink supply operation can be performed for each of the print heads 1 by using only the single pressure pump 11. Then, the purging operation is performed for all of the print heads 1, so that air bubbles remaining in the common ink chamber 7 and the nozzle 2 are reliably removed through the corresponding orifices.

Moreover, the second purging operation can be performed for removing the air bubbles in the print heads 1 by driving both the pressure pump 11 and the suction pump 22. With this configuration, a relatively large amount of ink can flow through the ink path without requiring the ink path to have a greater cross-sectional diameter. Accordingly, air bubbles can be effectively removed.

Figure 7:
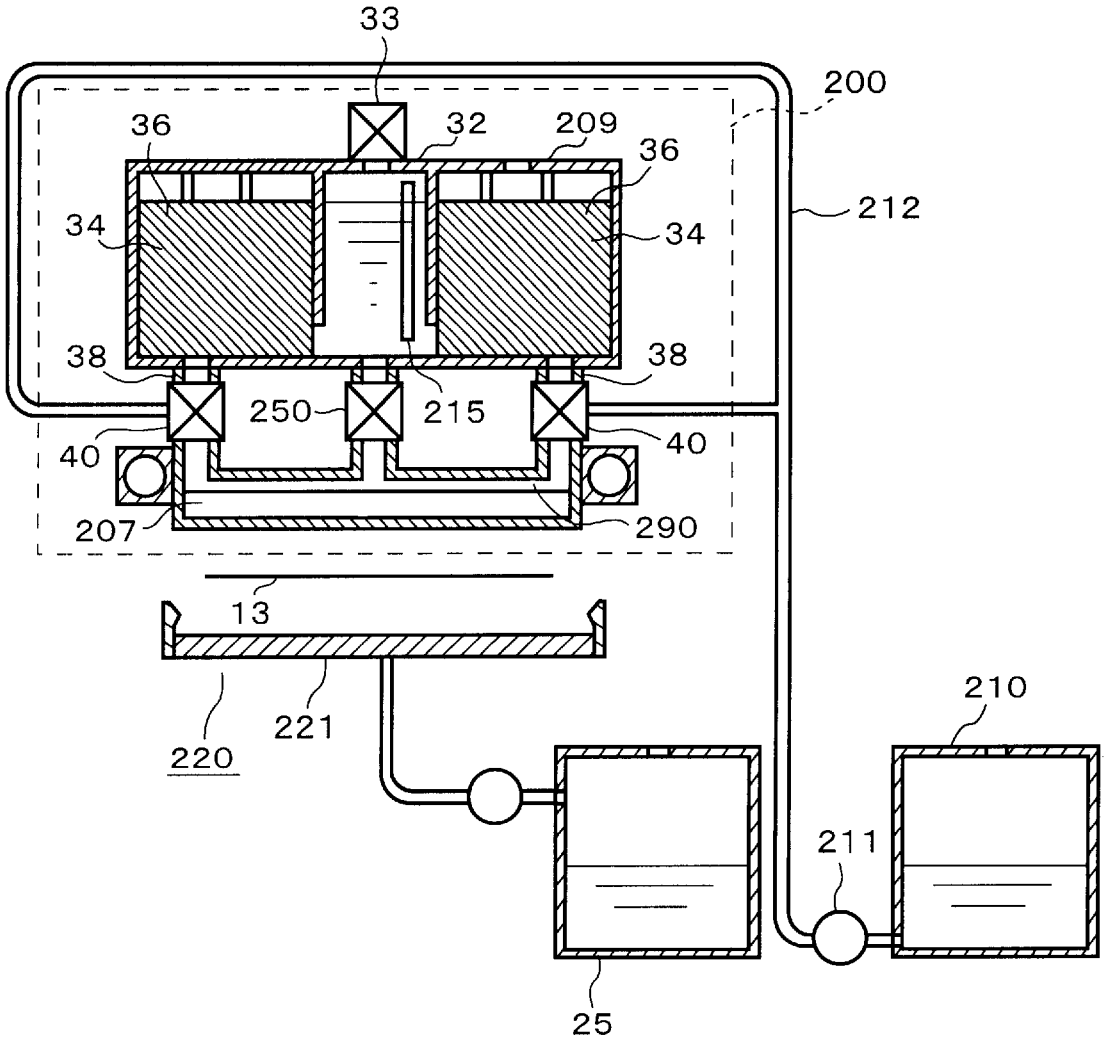
FIG. 7 is a cross-sectional view showing main components of an ink jet print device according to a third embodiment of the present invention.
Figure 8:
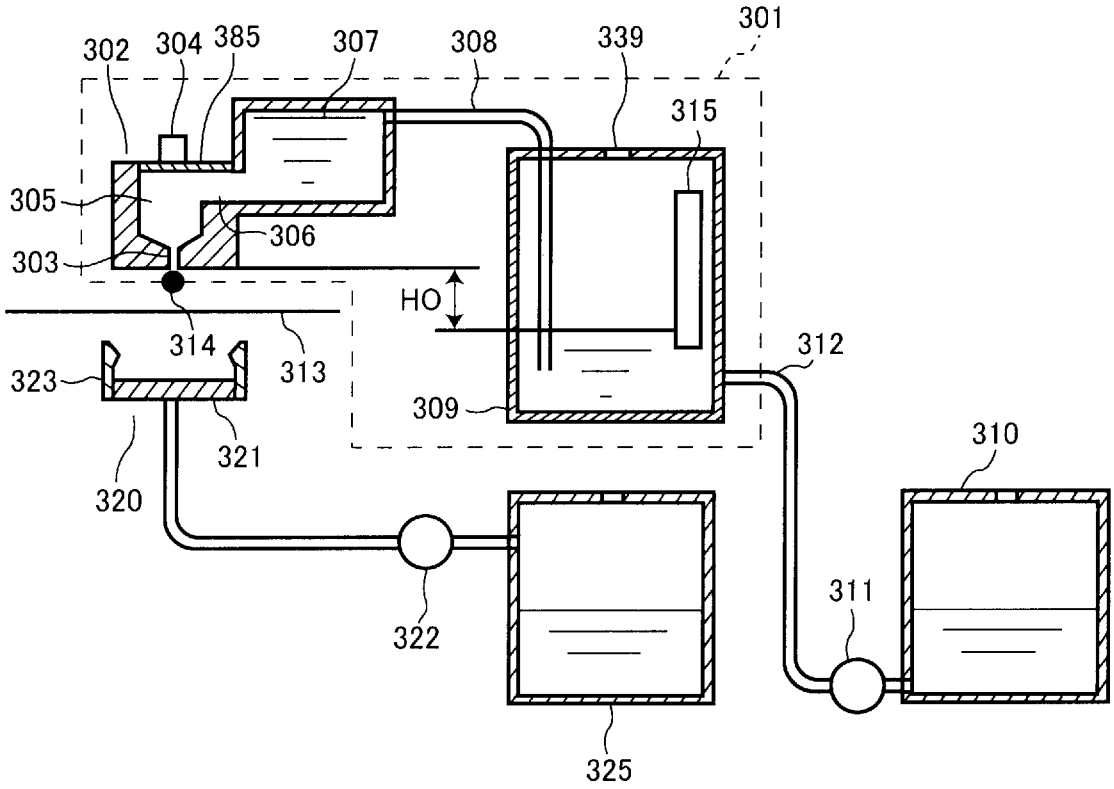
FIG. 8 is a cross-sectional view showing main components of a conventional ink jet print device.

Next, an ink jet print device according to a third embodiment of the present invention will be described while referring to FIG. 7. As shown in FIG. 7, the ink jet print device of the third embodiment includes a print head 200. The print head 200 is formed with a common ink chamber 207 which has a relatively large width, so that a greater number of the nozzles are provided to the print head 200 compared with the print head 1 of the first embodiment. A sub ink tank 209 is divided into an ink pool chamber 32 and a pair of ink absorbing chambers 34 sandwiching the ink pool chamber 32 therebetween. Absorbing members 36 are housed in each of the ink absorbing chambers 34. A switching valve 50 is provided below the ink pool chamber 32. Switching valves 40 are provided to each of the ink absorbing chambers 34 at corresponding outlet ports 38 formed to the ink absorbing chambers 34. A sensor 15 and a switching valve 33 are provided to the ink pool chamber 32.

A main ink tank 210 is connected to each switching valve 40 by a duct 212 via a pressure pump 211. A purging mechanism including a cap 221 is provided at a predetermined purging position.

During the printing operation, the switching valve 250 and the switching valve 33 are closed. Also, the switching valves 40 are set to the first condition so that the ink absorbing chambers 34 are in a fluid communication with the common ink chamber 207 via the corresponding outlet ports 38, and that the common ink tank 210 is fluidly disconnected from the common ink chamber 207. In this condition, ink is supplied from the both ink absorbing chambers 34 through the outlet ports 38 and the switching valves 40 into the common ink chamber 207 and further into the nozzles. Because ink is provided into the ink chamber 207 from its both sides, ink supply to the common ink chamber 207 can be efficiently performed. For this reason, although the common ink chamber 207 has a relatively long width, sufficient ink can be supplied to a large number of nozzles. Because the print head 200 has a greater number of nozzles than the print head 1 of the first embodiment, the print speed can be improved.

When the sensor 215 detects an low ink level that indicates that the ink amount in the ink pool chamber 32 is below a predetermined ink amount, then the printing operation is stopped. The print head 200 is moved to the purging position where the purging mechanism 220 is provided. The purging mechanism 220 places the cap 221 over orifices of the print head 200. The switching valves 40 are set to the second condition so that the main ink tank 210 is fluidly connected-to the common ink chamber 207 and that the ink absorbing chambers 36 are fluidly disconnected from the common ink chamber 207. The switching valve 50 is set to the open condition. Then, the pressure pump 211 is driven so that ink is supplied from the main ink tank 210 to the common ink chamber 207 and further into the ink pool chamber 32.

It should be noted that as shown in FIG. 7, a filter 290 can be provided between the switching valves 40 and the common ink chamber 207. In this case, reliability of the print head 200 can be enhanced. Alternatively, an absorption piece having a filtering function can be mounted to the outlet ports 38.

As described above according to the present invention, the ink supply operation for supplying ink from a main ink tank to a sub ink tank is performed when the printing operation is not performed. Also, the purging operation is performed immediately after the ink supply operation. Therefore, the purging mechanism can have a simple configuration. Also, ink amount consumed for removing air bubbles from a common ink chamber and the like can be greatly reduced. This reduces running cost of the ink jet print device.

Also, according to the present invention, the ink supply operation is performed for supplying ink from a main ink tank into a sub ink tank. At this time, air bubbles existing in a common ink chamber and the like can be removed. Also, the common ink chamber selectively functions as an ink supply path for supplying ink from the sub ink tank to a nozzle and as an ink introducing path for introducing ink from the main ink tank to the sub ink tank. Therefore, an ink jet print device having a simple configuration for removing air bubbles can be provided at low production costs.

Also, an ink jet print device according to the present invention can selectively perform at least two types of purging operation, that is, the purging operation and the second purging operation, by using a suction pump or both a pressure pump and the suction pump. By performing appropriate purging operation, air bubbles can be reliably removed even from a common ink chamber, a connecting portion between a ristrictor and the common ink chamber, and a connection portion between the common ink chamber and a sub ink tank, while ink amount consumed for purging operation can be reduced. Therefore, reliable ink jet print device can be provided at low costs.

Further, a switching valve is provided to an ink pool chamber so as to expose ink in the ink pool chamber to ambient air. Air bubbles collected from a common ink chamber into the ink pool chamber are released to the outside through the switching valve. With this configuration, reliability of a print head is secured for a long period of time.

Also, the purging operation and the ink supply operation are both performed at the predetermined same purging position. Therefore, an ink jet print device can be formed in a compact size, and also overall printing operation can be performed at high speed.

What is claimed is:

1. An ink jet print device comprising:

a head formed with a plurality of nozzles and a common ink chamber in fluid communication with each of the nozzles, each nozzle being formed with an orifice through which an ink droplet is ejected, the common ink chamber having a first end and a second end;

a sub ink tank that stores ink and supplies the ink to the nozzles;

a main ink tank that stores ink and supplies the ink to the sub ink tank;

a first switching valve provided to the first end of the common ink chamber, the first switching valve being selectively switched to an opening condition where the common ink chamber is in fluid connection with the sub ink tank and a closed condition where the common ink chamber is in fluid disconnection from the sub ink tank; and a second switching valve provided to the second end of the common ink chamber, the second switching valve being selectively switched to a first condition where the common ink chamber is in fluid connection with the sub ink tank and fluid disconnection from the main ink tank and a second condition where the common ink chamber is in fluid connection with the main ink tank and fluid disconnection from the sub ink tank, wherein the sub ink tank supplies the ink to the nozzles through the common ink chamber, and the main ink tank supplies the ink to the sub ink tank through the common ink chamber.

2. The ink jet print device according to claim 1, further comprising a purging mechanism that performs a purging operation for collecting ink from the head through the orifices.

3. The ink jet print device according to claim 1, further comprising an ink supply mechanism including a pressure pump provided between the second switching valve and the main ink tank, the ink supply mechanism performing an ink supply operation in a condition where the first switching valve is in the opening condition and the second switching valve is in the second condition such that the pressure pump supplies the ink from the main ink tank into the sub ink tank through the second switching valve, the common ink chamber, and the first switching valve.

4. The ink jet print device according to claim 2, further comprising a purging mechanism including a suction pump and a purging tank fluidly connected to the suction pump, the purging mechanism performing a purging operation wherein the suction pump generates negative pressure for collecting ink from the head through the orifices into the purging tank.

5. The ink jet print device according to claim 4, wherein the purging mechanism performs a first purging operation and a second purging operation different from the first purging operation.

6. The inkjet print device according to claim 5, wherein the purging mechanism performs the first purging operation using only the suction pump while the first switching valve is in the closed condition and the second switching valve is in the second condition, and performs the second purging operation using both the suction pump and the pressure pump while the first switching valve is in the closed condition and the second switching valve is in the first condition.

7. The ink jet print device according to claim 6, further comprising a controller controlling the purging mechanism and the ink supply mechanism, wherein the controller controls the purging mechanism to perform the first purging operation immediately after the ink supply mechanism has performed the ink supply operation.

8. The ink jet print device according to claim 4, wherein the head is movable between a print region and a purging position outside the print region, and the purging mechanism performs the purging operation while the head is positioned at the purging position, and the ink supply mechanism performs the ink supply operation while the head is positioned at the purging position.

9. The ink jet print device according to claim 4, further comprising an image forming mechanism selectively set to a driving condition and a non-driving condition, the image forming mechanism in the driving condition performing an image forming operation for selectively ejecting an ink droplet based on print signals, wherein the ink supply mechanism performs the ink supply operation only when the image forming mechanism is in the non-driving condition.

10. The ink jet print device according to claim 1, further comprising an ink absorbing member that absorbingly holds ink, wherein the sub ink tank is formed with a switching valve that is selectively set to an open condition and a closed condition, the switching valve in the open condition exposing the ink housed in the sub ink tank to ambient air, the sub ink tank being divided into an ink pool chamber and an ink absorbing chamber by a partition wall formed with an opening through which the ink pool chamber and an ink absorbing chamber are in fluid communication with each other, and the ink absorbing member is housed in the ink absorbing chamber.

11. The ink jet print device according to claim 1, further comprising a plurality of head units each including the head and the sub ink tank.

12. The ink jet recording device according to claim 1, further comprising a filter having a surface provided in the common ink chamber so as to extend from the first end side to the second end side of the common ink chamber, wherein when the first switching valve is in the opening condition and the second switching valve is in the second condition, the ink flows from the main ink tank into the sub ink tank through the common ink chamber along the surface of the filter.

13. An ink supply method comprising the steps of:

a) switching a first valve to fluidly connect a first side of a common ink chamber to a sub ink tank;

b) switching a second valve to fluidly connect a main ink tank to a second side of the common ink chamber and to fluidly disconnect the sub ink tank from the second side of the common ink chamber; and c) driving a pump provided between the main ink tank and the second side of the common ink chamber so as to provide ink from the main ink tank through the common ink chamber into the sub ink tank.

14. The ink supply method according to claim 13, wherein the first valve is repeatedly closed and opened during the driving step c).

15. The ink supply method according to claim 13, further comprising the step of d) detecting low ink level during a printing operation where the first valve is set to fluidly disconnect the sub ink tank from the first side of the common ink chamber and the second valve is set to fluidly connect the sub ink tank to the second side of the common ink chamber, the low ink level indicating that an ink amount in the sub ink tank is below a predetermined amount, wherein the steps a), b), and c) are executed in this order after the step d).

16. The ink supply method according to claim 13, further comprising the steps of e) detecting a high ink level indicating that an ink amount in the sub ink tank is above a predetermined amount, and f) stopping the pump from driving, wherein the steps of e) and f) are executed after the step c).

17. The ink supply method according to claim 13, wherein the step a) is executed when a command is received from a controller.

18. The ink supply method according to claim 17, wherein the controller outputs the command when no low ink level nor high ink level is detected.

* * * * *